United States Patent [19]

Vatsky

[11] 4,400,151

[45] Aug. 23, 1983

[54] CONTROLLED FLOW, SPLIT STREAM BURNER ASSEMBLY

[75] Inventor: Joel Vatsky, Millburn, N.J.

[73] Assignee: Foster Wheeler Energy Corporation, Livingston, N.J.

[21] Appl. No.: 383,227

[22] Filed: May 28, 1982

Related U.S. Application Data

[63] Continuation of Ser. No. 156,308, Jun. 4, 1980, abandoned.

[51] Int. Cl.[3] ..... F23M 9/00

[52] U.S. Cl. ..... 431/184; 431/188; 431/284; 110/264; 239/403; 239/416.5

[58] Field of Search ..... 431/8, 12, 173, 184, 431/182, 188, 187, 186, 284; 239/574, 416.5, 417.5, 403, 465; 110/263, 264

[56] References Cited

U.S. PATENT DOCUMENTS

| | | | |
|---|---|---|---|
| 1,995,934 | 3/1935 | Mangold | 239/416.5 |
| 2,271,587 | 2/1942 | Haynes | 431/184 X |
| 2,480,547 | 8/1976 | Caracristi | 431/188 |
| 2,838,103 | 6/1958 | Voorheis | 431/184 X |
| 2,889,871 | 6/1959 | Voorheis | 431/184 X |
| 3,391,981 | 7/1968 | Voorheis et al. | 431/184 X |
| 3,944,142 | 3/1976 | Welden et al. | 239/552 |
| 4,253,403 | 3/1981 | Vatsky | 431/188 X |
| 4,348,170 | 9/1982 | Vatsky et al. | 431/188 |

*Primary Examiner*—Samuel Scott
*Assistant Examiner*—Randall L. Green
*Attorney, Agent, or Firm*—Marvin A. Naigur; John E. Wilson; Warren B. Kice

[57] ABSTRACT

A burner assembly in which an inlet is located at one end of an annular passage for receiving fuel, and an outlet is located at the other end of the passage for discharging the fuel. A plurality of blocks are disposed within the annular passage for splitting up the fuel discharging from said outlet so that, upon ignition of said fuel, a plurality of flame patterns are formed. A register assembly is provided which includes an enclosure for receiving air and a divider for directing the air from the enclosure towards the outlet in two parallel paths extending around the burner. Registers are disposed in each of the paths for regulating the quantity of air flowing through the paths.

2 Claims, 4 Drawing Figures

CONTROLLED FLOW, SPLIT STREAM BURNER ASSEMBLY

This application is a continuation, of application Ser. No. 156,308, filed June 4, 1980 now abandoned.

BACKGROUND OF THE INVENTION

This invention relates generally to a burner assembly and more particularly to an improved burner assembly which operates in a manner to reduce the formation of nitrogen oxides as a result of fuel combustion.

Considerable attention and efforts have recently been directed to the reduction of nitrogen oxides resulting from the combustion of fuel, and especially in connection with the use of coal in the furnace sections of relatively large installations such as vapor generators and the like. In a typical arrangement for burning coal in a vapor generator, several burners are disposed in communication with the interior of the furnace and operate to burn a mixture of air and pulverized coal. The burners used in these arrangements are generally of the type in which a fuel air mixture is continuously injected through a nozzle so as to form a single relatively large flame. As a result, the surface area of the flame is relatively small in comparison to its volume, and therefore the average flame temperature is relatively high. However, in the burning of coal, nitrogen oxides are formed by the fixation of atmospheric nitrogen available in the combustion supporting air, which is a function of the flame temperature. When the flame temperature exceeds 2800° F., the amount of fixed nitrogen removed from the combustion supporting air rises exponentially with increases in the temperature. This condition leads to the production of high levels of nitrogen oxides in the final combustion products, which causes severe air pollution problems.

Nitrogen oxides are also formed from the fuel bound nitrogen available in the fuel itself, which is not a direct function of the flame temperature, but is related to the quantity of available oxygen during the combustion process.

In view of the foregoing, attempts have been made to suppress the burner and flame temperatures and reduce the quantity of available oxygen during the combustion process and thus reduce the formation of nitrogen oxides. Attempted solutions have included techniques involving two stage combustion, flue gas recirculation, the introduction of an oxygen-deficient fuel-air mixture to the burner and the breaking up of a single large flame into a plurality of smaller flames. However, although these attempts singularly may produce some beneficial results they have not resulted in a reduction of nitrogen oxides to minimum levels. Also, these attempts have often resulted in added expense in terms of increase construction costs and have lead to other related problems such as the production of soot and the like.

SUMMARY OF THE INVENTION

It is therefore an object of the present invention to provide a burner assembly which operates in a manner to considerably reduce the production of nitrogen oxides in the combustion of fuel without any significant increase in cost or other related problems.

It is a more specific object of the present invention to provide a burner assembly in which the surface area of the flame per unit volume is increased which results in a greater flame radiation, a lower flame temperature, and a shorter residence time of the gas component within the flame at maximum temperature.

It is a more specific object of the present invention to provide a burner assembly of the above type in which the fuel is passed through an annular passage and is split into separate streams by a plurality of blocks disposed in the annular passage and having a unique design.

It is a still further object of the present invention to provide a burner assembly of the above type in which the stoichiometric combustion of the fuel is regulated to reduce the quantity of available oxygen during the combustion process and achieve an attendant reduction in the formation of nitrogen oxides.

Another more specific object of the present invention is to provide a burner assembly of the above type in which secondary air is directed toward the burner outlet in two parallel paths with register means being disposed in each path for individually controlling the flow of air through each path.

Toward the fulfillment of these and other objects, the burner assembly of the present invention includes an annular passage having an inlet located at one end thereof for receiving fuel, and an outlet located at the other end of the passage for discharging the fuel. A plurality of blocks are disposed within the annular passage for splitting up the fuel discharging from the opening so that upon ignition of the fuel, a plurality of flame patterns are formed. Air is directed towards the outlet in two parallel paths extending around the burner, and a plurality of register vanes are disposed in each of the paths for regulating the quantity of air flowing through the paths.

DESCRIPTION OF THE PREFERRED EMBODIMENTS

Figure 1:
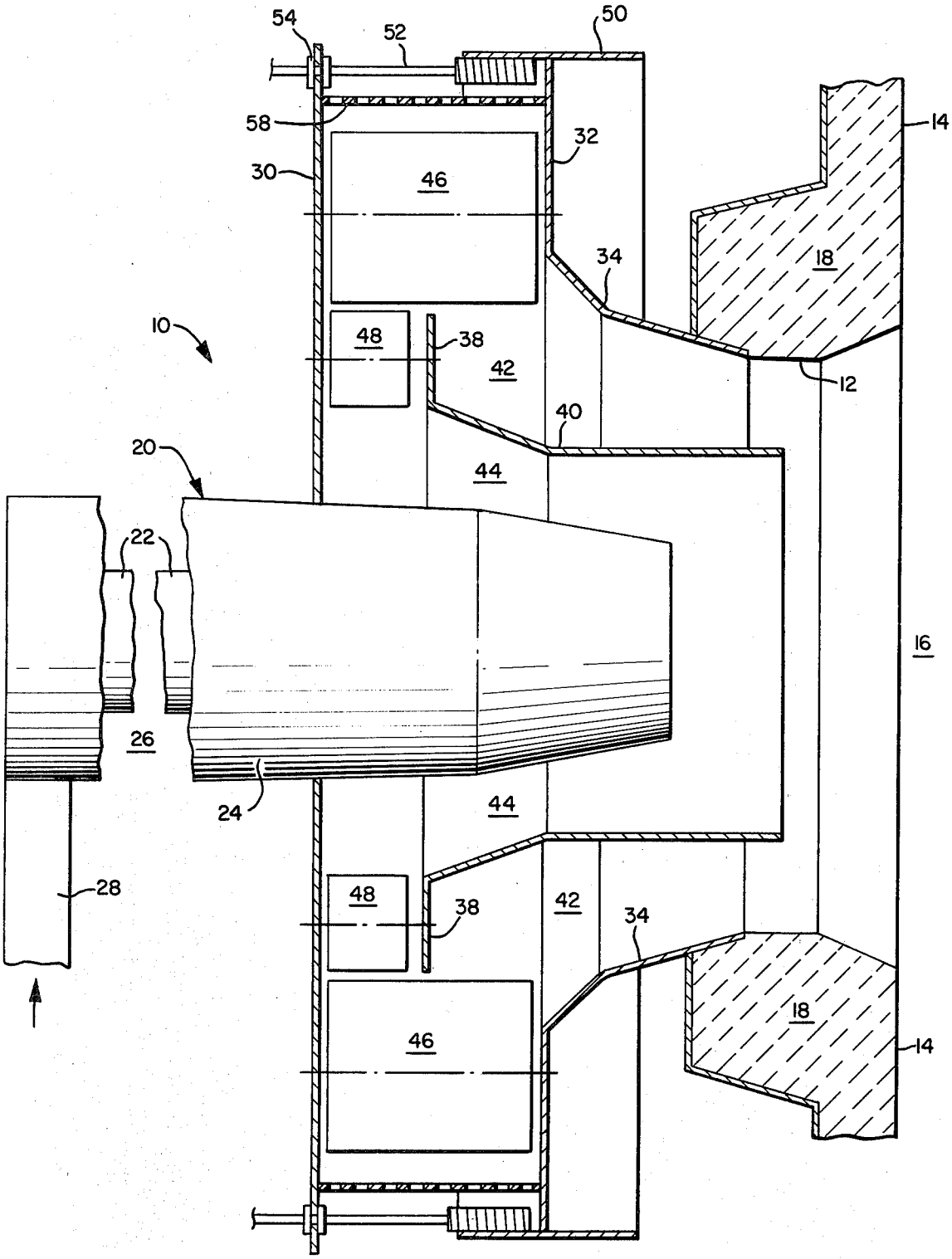
FIG. 1 is a sectional view depicting the burner assembly of the present invention.

Referring specifically to FIG. 1 of the drawings the reference numeral 10 refers in general to a burner assembly which is disposed in axial alignment with a through opening 12 formed in a front wall 14 of a conventional furnace. It is understood that the furnace includes a back wall and side walls of an appropriate configuration to define a combustion chamber 16 immediately adjacent the opening 12. Also similar openings are provided in the furnace front wall 14 for accommodating additional burner assemblies identical to the burner assembly 10. The inner surface of the wall 14 as well as the other walls of the furnace are lined within an appropriate thermal insulation material 18 and, while not specifically shown, it is understood that the combustion chamber 16 can also be lined with vertically extending boiler tubes through which a heat exchange fluid, such as water, is circulated in a conventional manner for the purposes of producing steam.

It is also understood that a vertical wall is disposed in a spaced parallel relationship with the furnace wall 14 in a direction opposite that of the furnace opening 12 along with correspondingly spaced top, bottom and side walls to form a plenum chamber, or wind box, for receiving combustion supporting air, commonly referred to as "secondary air", in a conventional manner.

The burner assembly 10 includes a nozzle 20 having an inner tubular member 22 and an outer tubular member 24. The outer tubular member 24 extends over the inner tubular member 22 in a coaxial, spaced relationship thereto to define an annular passage 26 which extends towards the furnace opening 12.

A tangentially disposed inlet 28 communicates with the outer tubular member 24 for introducing a stream of fuel into the annular passage 26 as will be explained in further detail later.

A pair of spaced annular plates 30 and 32 extend around the burner 20, with the inner edge of the plate 30 terminating on the outer tubular member 24. A liner member 34 extends from the inner edge of the plate 32 and in a general longitudinal direction relative to the burner 20 and terminates adjacent the insulation material 18 just inside the wall 14. An additional annular plate 38 extends around the burner 20 in a spaced, parallel relation with the plate 30. An air divider sleeve 40 extends from the inner surface of the plate 38 and between the liner 34 and the nozzle 20 in a substantially parallel relation to the burner 20 in a substantially parallel relation to the burner 20 and the liner 34 to define two air flow passages 42 and 44.

A plurality of outer register vanes 46 are pivotally mounted between the plates 30 and 32 to control the swirl of secondary air from the wind box to the air flow passages 42 and 44. In a similar manner a plurality of inner register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the register vanes 46 and 48 may be done in any conventional manner, such as by mounting the vanes on shafts (shown schematically in FIG. 1) and journalling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

Figure 2:
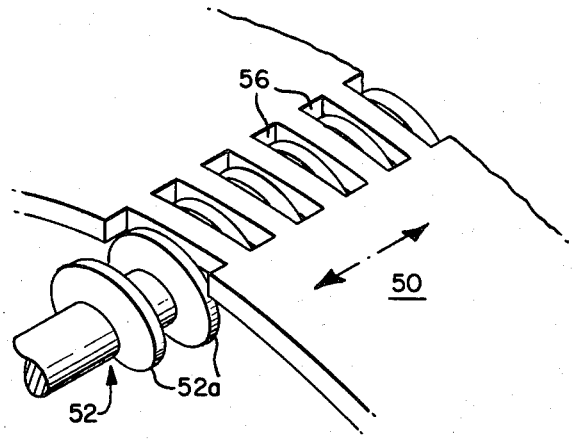
FIG. 2 is a partial perspective view of a component of the burner assembly of FIG. 1.

The quantity of air flow from the wind box into the register vanes 46 is controlled by movement of a sleeve 50 which is slidably disposed on the outer periphery of the plate 32 and is movable parallel to the longitudinal axis of the burner nozzle 20. An elongated worm gear 52 is provided for moving the sleeve 50 and is better shown in FIG. 2. The worm gear 52 has one end portion suitably connected to an appropriate drive means (not shown) for rotating the worm gear and the other end provided with threads 52*a*. The worm gear 52 extends through a bushing 54 (FIG. 1) which is attached to the plate 30 to provide rotatable support. The threads 52*a* of the worm gear 52 mesh with appropriate apertures 56 formed in the sleeve 50 so that, upon rotation of the worm gear, the sleeve moves longitudinally with respect to the longitudinal axis of the burner 20 and across the air inlet defined by the plates 30 and 32. In this manner, the quantity of combustion supporting air from the wind box passing through the air flow passages 42 and 44 can be controlled by axial displacement of the sleeve 50. A perforated air hood 58 extends between the plates 30 and 32 immediately downstream of the sleeve 50 to permit independent measurement of the air flow to the burner 20.

Figure 3:
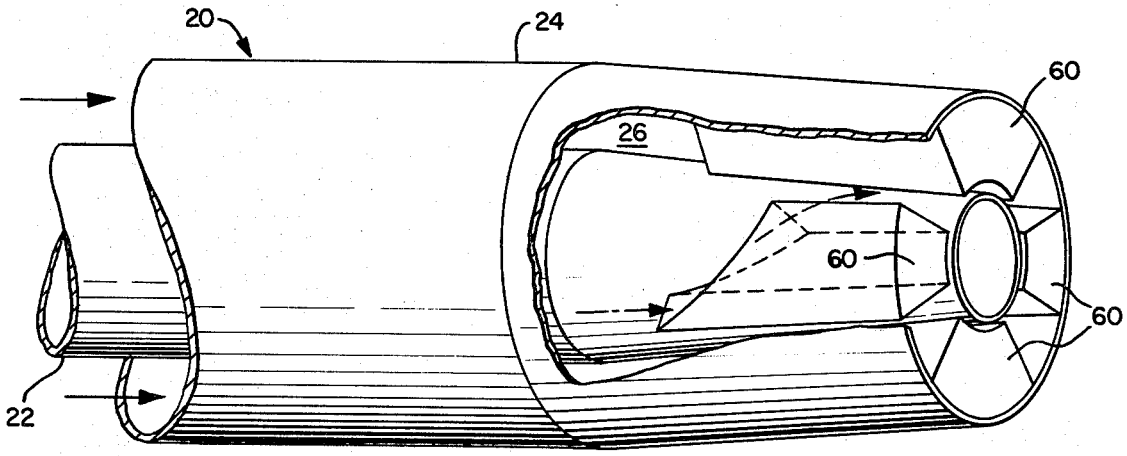
FIG. 3 is an enlarged elevational view, partially cutaway, of the burner portion of the assembly of the present invention.
Figure 4:
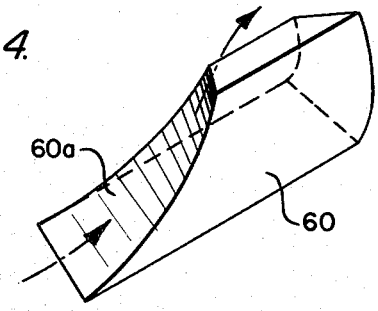
FIG. 4 is a perspective view of a component of the burner portion f FIG. 3.

As shown in FIG. 3, which depicts the details of the burner nozzle 20, the end portion of the outer tubular member 24 and the corresponding end portion of the inner tubular member 22 are tapered slightly radially inwardly toward the furnace opening 12. A plurality of divider blocks 60 are circumferentially spaced in the annular space between the tubular members 22 and 24 in the outlet end portion of the burner. As shown in FIG. 3, four such blocks 60 are spaced at 90° intervals and extend from the outlet to a point approximately midway the tapered portions of the members 22 and 24. The side portion of the blocks 60 are curved to complement the corresponding curved surfaces of the tubular members 22 and 24 and the blocks are tapered radially inwardly. As shown in FIG. 4, the leading end portion of each block 60 is configured in a curved relationship so that the fuel flowing in the passage 26 and impinging against the leading ends of the blocks 60 will be directed into the adjacent spaces defined between the blocks to facilitate the splitting of the fuel stream into four separate streams.

In operation of the burner assembly of the present invention, the movable sleeve 50 associated with each burner is adjusted during initial start up to accurately balance the air to each burner. After the initial balancing, no further movement of the sleeves 50 are needed since normal control of the secondary air to the burners is accomplished by operation of the outer register vanes 46.

Fuel, preferably in the form of pulverized coal suspended or entrained within a source of primary air, is introduced into the tangential inlet 28 where it swirls through the annular chamber 26 and is ignited by suitable igniters (not shown) appropriately positioned with respect to the burner nozzle 20. The stream of fuel and air encounters the blocks 60 at the end portion of the nozzle 20 whereby the stream is split into four equally spaced streams which, upon ignition, form four separate flame patterns. The igniters are shut off after steady state combustion has been achieved and secondary air from the wind box is admitted through the perforated hood 58 and into the inlet between the plates 30 and 32. The axial and radial velocities of the air is controlled by the register vanes 46 and 48 as it passes through the air flow passages 42 and 44 and into the furnace opening 12 for mixing with the fuel from the burner 20.

As a result of the foregoing, several advantages result from the burner assembly of the present invention. For example, since the pressure drop across the perforated air hoods 58 associated with burner assemblies can be equalized by balancing the secondary air flow to each burner by initially adjusting the sleeves 50, a substantially uniform gas distribution can be obtained across the furnace. This also permits a common wind box to be used and enables the unit to operate at lower excess air with significant reductions in both nitrogen oxides and carbon monoxides. Also, the provision of separate register vanes 46 and 48 for the outer and inner air flow passages 42 and 44 enables secondary air distribution as well as flame shape to be independently controlled resulting in a significant reduction of nitrogen oxides, and a more gradual mixing of the primary air coal stream with the secondary air since both streams enter the furnace on parallel paths with controlled mixing.

Further, the provision of multiple flame patterns results in a greater flame radiation, a lower average flame temperature and a shorter residence time of the gas components within the flame at a maximum temperature, all of which, as stated above, contribute to reduce the formation of nitric oxides.

Also, the use of the curved surface 60*a* on the blocks results in a more streamline flow of the fuel stream before it discharges from the outlet of the nozzle 20. Still further, the provision of the tangential inlet 26 provides excellent distribution of the fuel around the annular space 26 in the burner 20, resulting in more complete combustion and reduction of carbon loss and making it possible to use individual burners with capacities significantly higher than otherwise could be used.

It is understood that several variations and additions may be made to the foregoing within the scope of the invention. For example, since the arrangement of the present invention permits the admission of air at less than stoichiometric, overfire air ports, or the like can be provided as needed to supply air to complete the combustion.

As will be apparent to those skilled in the art, various changes and modifications may be made to the embodiments of the present invention without departure from the spirit and scope of the present invention as defined in the appended claims and the legal equivalent.

I claim:

1. A burner system for a furnace comprising a plurality of burner assemblies each comprising an inner tubular member, and an outer tubular member extending around said inner tubular member in a coaxial relation thereto to define an annular fuel passage, an inlet located at one end of said fuel passage and extending tangential to said passage for introducing fuel into said passage, an outlet located at the other end of said passage for discharging said fuel, a plurality of spaced blocks disposed in said fuel passage and extending flush with said outlet, one end of each of said blocks having a curved surface against which said fuel impinges, said curved surfaces directing said fuel into the spaces between said blocks and towards said outlet for splitting up the fuel discharging from said outlet so that upon ignition of said fuel, a plurality of flame patterns are formed; and a register assembly associated with each burner assembly, each register assembly comprising an enclosure extending around a corresponding burner assembly and having an inlet for receiving air from a windbox, means for directing said air from said inlet in a radial air path towards said burner assembly, means disposed downstream of said radial air path for defining two additional air paths communicating with said radial air path, at least a portion of each of said additional air paths extending parallel in a radially spaced relationship with said fuel passage, first register means disposed in said radial air path for imparting a swirl to said air as it passes through said radial air path and second register means disposed in one of said additional air paths, said first and second register means being adjustable to regulate said swirl, and a sleeve movable across said enclosure inlet to vary the size of said inlet and the quantity of air flow through said inlet to correct for variations in the quantity of air flow to each burner assembly caused by said regulation of said swirl, to balance the air flow to each burner assembly.

2. The burner system of claim 1 wherein said blocks extend between said tubular members and are tapered in a direction from said outer tubular member to said inner tubular member.

* * * * *